United States Patent [19]

O'Connor

[11] Patent Number: 4,590,951

[45] Date of Patent: May 27, 1986

[54] BREATHING APPARATUS

[75] Inventor: Richard K. O'Connor, London, England

[73] Assignee: Racal Safety Limited, Wembley, England

[21] Appl. No.: 617,910

[22] Filed: Jun. 6, 1984

[30] Foreign Application Priority Data

Jun. 7, 1983 [GB] United Kingdom ..... 8315589
Nov. 11, 1983 [GB] United Kingdom ..... 8330142

[51] Int. Cl.[4] ..... A62B 7/10

[52] U.S. Cl. ..... 128/204.23; 128/201.25; 128/205.12; 417/38

[58] Field of Search ..... 128/201.25, 204.21, 128/204.22, 204.23, 202.22, 204.26, 204.28, 205.12, 205.25, 205.18, 206.12, 206.15, 201.28; 417/38

[56] References Cited

U.S. PATENT DOCUMENTS 3,799,702 3/1974 Weishaar ..... 417/38
4,430,995 2/1984 Hilton ..... 128/205.12
4,502,480 3/1985 Yamamoto ..... 128/205.12

FOREIGN PATENT DOCUMENTS 2032284 5/1980 United Kingdom ..... 128/201.25

*Primary Examiner*—Henry J. Recla
*Attorney, Agent, or Firm*—Scrivener Clarke Scrivener and Johnson

[57] ABSTRACT

A power assisted respirator comprises a facepiece for covering at least the nose and mouth of the wearer which has an outlet provided with a one-way exhale valve which is openable to permit air to flow out of the facepiece when a predetermined pressure P is established within the facepiece. A pump unit supplies air to the space within the facepiece. The pump unit may be connected to an inlet of the facepiece by a flexible hose or may be mounted directly on or in the facepiece. A filter canister is connected to the inlet of the pump means for filtering air supplied to the facepiece. A one-way inlet valve is provided in the path of air flowing from the pump unit to the facepiece and a pressure sensor is provided for sensing the pressure of air in the region of the pump unit inlet for causing deenergisation of the pump unit when the pressure in the region of the pump unit inlet exceeds a predetermined level. The operating parameters of the pump of the pump unit and the exhale valve are selected so that the pressure within the facepiece at which the exhale valve will open slightly exceeds the pressure at the outlet of the pump which will cause the pump to cease or substantially cease operating effectively.

15 Claims, 10 Drawing Figures

BREATHING APPARATUS

The present invention relates to breathing apparatus of the type known as power respirators or power-assisted respirators in which filtered air is pumped to a facepiece covering at least the mouth of the wearer to ensure a supply of clean breathable air in a dusty or otherwise contaminated environment.

The main benefit to the wearer of using a powered respirator is that his lungs are relieved of the slight strain caused by inhalation against the resistance of the filters which, in a conventional non-powered respirator, are attached directly to the facepiece.

In addition, the powered respirator, by delivering a steady stream of air to the facepiece usually maintains a slight positive pressure within the facepiece, as determined by the resistance of an exhale valve, thus ensuring that leakage due to a badly fitting facepiece is outward rather than inward.

Such a powered respirator has been used extensively for the filtration of hazardous dusts, e.g. asbestos, where the high-efficiency filters required by this hazard would otherwise impose an unacceptable inhalation strain on the wearer, particularly during heavy exertion involved in asbestos stripping operations.

However its use to filter gases and vapours leads to rapid depletion of the absorbent filters with a consequently limited filter life and increased operating costs. Various ways have been sought of increasing filter life, such for example as described in European Pat. No. 0094757 A2.

However such powered respirators are normally battery operated and another limitation on their use is the life of the battery, before replacement or recharging. Additionally, there exist a few specialised applications where the contaminent level is extremely low and where the life of the filters is not the major problem. The prime objective then changes from extending filter life to lengthening the battery life.

According to the present invention there is provided a power assisted respirator comprising a facepiece for covering at least the mouth of the wearer and having an inlet and an outlet for air, one-way exhale valve means in the outlet which is operable to permit air to flow out of the space within the facepiece when a predetermined differential pressure is established thereacross, pump means for supplying air to the space within the facepiece and having inlet means for air, power means connected to the pump means for energising the pump means, one-way inlet valve means in the path of air flowing from the pump means to the space within the facepiece permitting air to flow to the said space, the operating parameters of the pump means and the exhale valve means being selected so that, during exhalation by the wearer, the inlet valve means will close and the pump means will be placed in a condition in which it will cease or substantially cease to operate effectively, filter means connected to the pump means inlet means for filtering air supplied thereto, a pressure sensor for sensing the pressure of air between the pump means and the filter means, and control means for causing disconnection of the pump means from the power means when the pressure sensed by the pressure means rises above a preset level.

In a preferred embodiment, the exhale valve is arranged to open when the pressure within the facepiece exceeds a predetermined pressure P, for example in the range 150 to 600 Pascals above atmospheric pressure. The pump is arranged so that it will cease or substantially cease to operate effectively, i.e. so that, although the fan continues to rotate, no or substantially no air is driven thereby, when the pressure downstream of the pump and upstream of the inlet valve is slightly less than the predetermined pressure P. During exhalation by the wearer, the pressure within the facepiece will increase towards the pressure P and at the point when the pressure within the facepiece exceeds that downstream of the pump, the inlet valve means will close, the pump will cease or substantially cease to pump effectively and the exhale valve will open. During normal operation of the pump means, because of the resistance to flow presented by the filter means, the pressure between the filter means and the pump means will be sub-atmospheric. When the pump means ceases or substantially ceases to pump effectively, the pressure in this region will begin to rise to the preset level, for example in the range 100 to 140 Pascals below atmospheric pressure, which is sensed by the pressure sensor which then causes disconnection of the pump means from the power means. The pump means is re-energised following the reduction in pressure at the start of inhalation which is communicated to the pump means.

The inlet valve means preferably comprises one or more one-way valves which are arranged so that the or each valve will close as soon as the pressure downstream thereof exceeds the pressure upstream.

The pump means preferably comprises a fan and a d.c. motor which may be provided in a housing connected for mounting directly on the facepiece or for connection to the facepiece by a flexible hose and for mounting on the body of the wearer. Alternatively, the pump means may be housed within the facepiece.

The power means for the pump means may comprise an energisation circuit including one or more batteries and the control means may comprise a switch operable by the pressure sensor and connected in the energisation circuit of the motor. The energisation circuit may also include an on/off switch for operation by the wearer.

The facepiece may be a partial or full face mask, or may be in the form of a helmet or hood if adequately sealed to the head. Where the facepiece is a face mask, it may comprise an outer mask provided with the facepiece inlet and an inner mask provided with the facepiece outlet, the inner mask being provided with one or more apertures, the or each of which is provided with a one-way valve permitting air to flow into the space within the inner mask. The inlet valve means may be provided either by a valve at the facepiece inlet or by the one-way valves associated with the inner mask apertures. Where the pump means is housed within the facepiece, it is conveniently housed within the outer mask, the facepiece inlet then providing the pump means inlet.

Embodiments according to the present invention will now be described, by way of example only, with reference to the accompanying drawings, in which.

Figure 1:
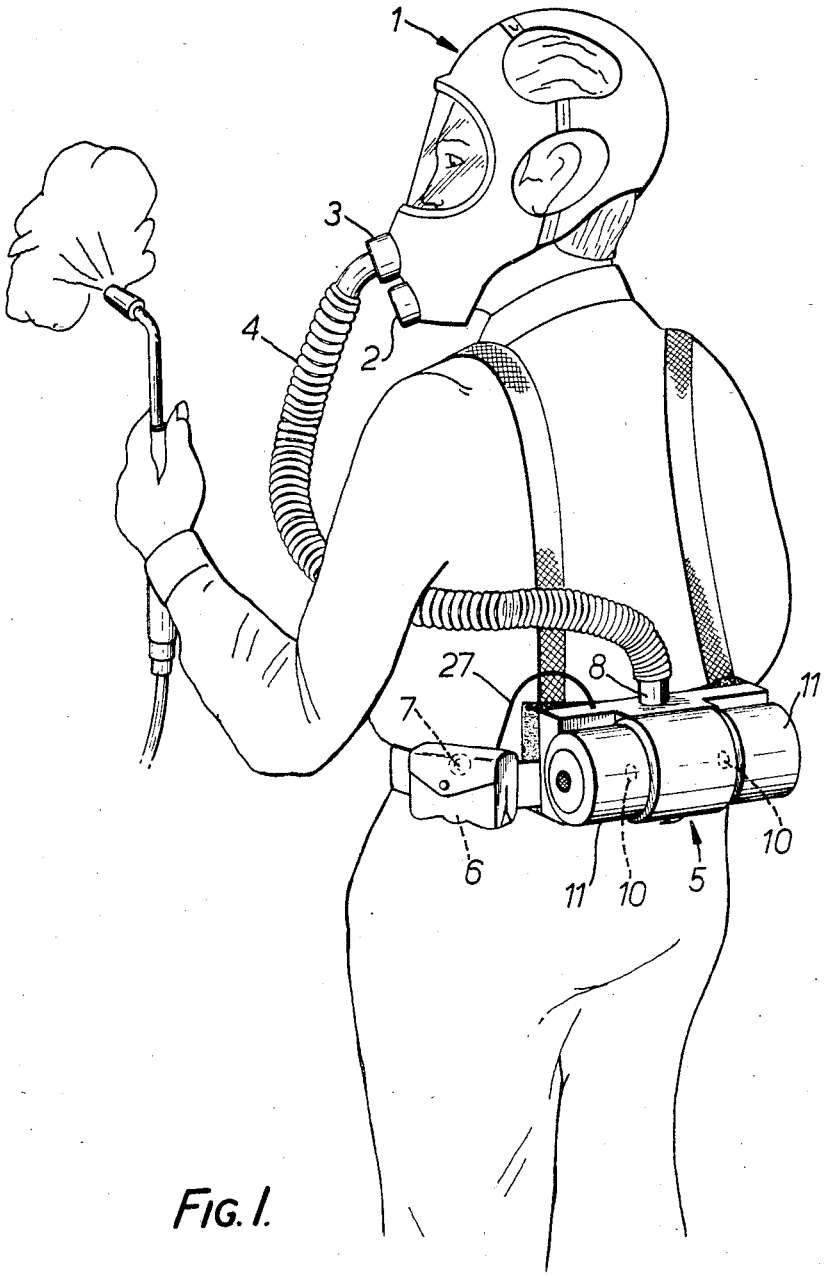
FIG. 1 is a perspective view of an embodiment of respirator in use.
Figures 2, 3:
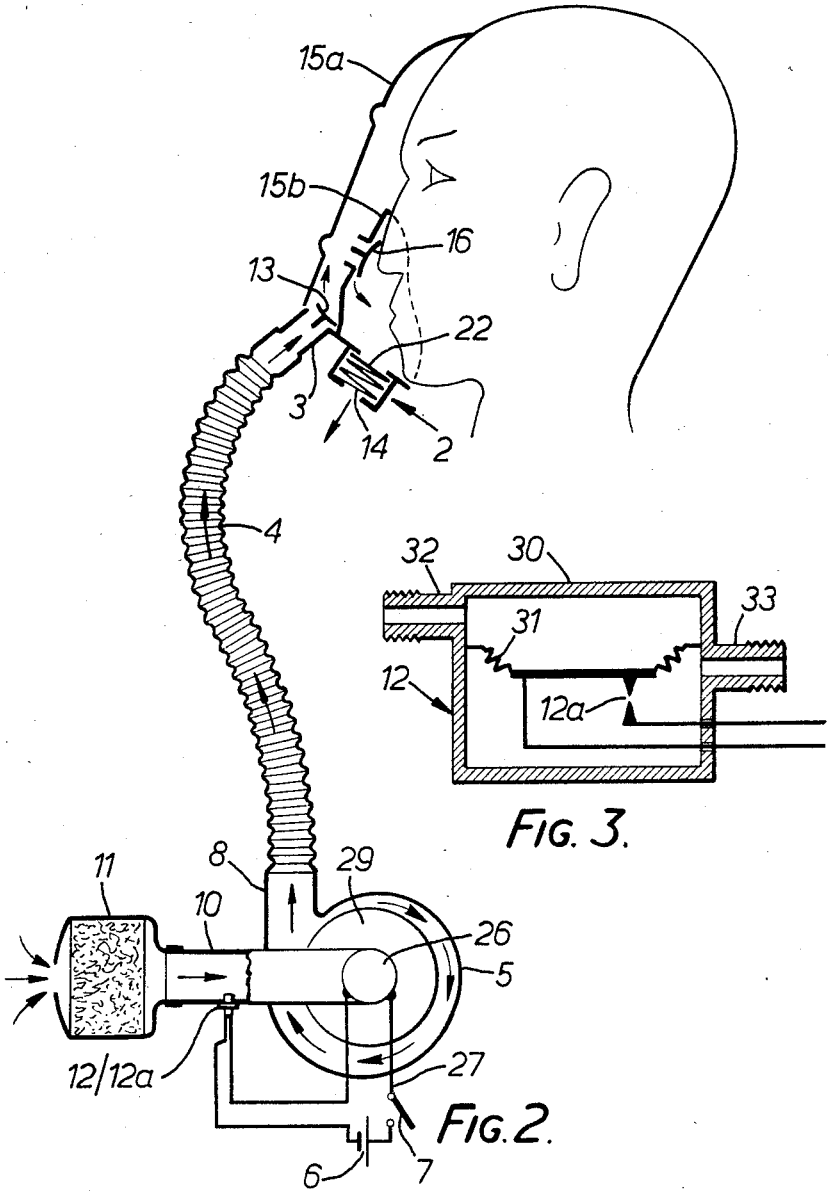
FIG. 2 is a diagrammatic view of the respirator of FIG. 1.
FIG. 3 is a diagrammatic view of the pressure sensor and associated control means of the respirator of FIGS. 1 and 2.

The respirator shown in FIGS. 1 and 2 comprises a facepiece 1 which, as shown, comprises a full face mask covering the eyes, nose and mouth of the wearer, which is held on the wearer's head by retaining means extending around the back of the wearer's head, and which is peripherally sealed to the head of the wearer. The facepiece 1 is provided with an outlet provided with a one-way outlet or exhale valve 2 through which air leaves the mask, and an inlet 3. As shown the inlet 3 is connected by a flexible hose 4 to a pump unit 5. The pump unit 5 is, as shown, supported by a harness on the back of the wearer but may alternatively be supported by a similar harness on the front of the wearer. The unit 5 comprises a housing in which a pump comprising a fan, for example a centrifugal fan, and a battery operated d.c. motor driving the fan are housed and will be described in more detail hereafter. The pump unit housing has an outlet 8 defining the outlet of the fan and to which the hose 4 is connected, and one, or a plurality of, for example as shown two, inlets 10 connected to the fan inlet. Each of the housing inlets 10 is threaded to receive a filter canister 11, which may comprise a particulate filter material and/or a gas and/or vapour filter material. One such canister 11 may be mounted on the or each or some of the inlets 10 and any unused inlets may be closed by a plug (not shown).

It will be appreciated that by increasing the number of filter canisters 11 provided the rate of flow of air through each canister can be reduced, thereby increasing the efficiency of filtering and reducing the resistance to flow of air through the filter means.

The motor is connected, as shown, by a cable 27 of a motor energisation circuit to a separate unit comprising a casing housing one or more batteries 6 and optionally an on/off switch 7 operable by the wearer for controlling power supplied to the motor. Alternatively the battery or batteries and, where provided, the switch 7 may be mounted in and on the pump unit 5.

As shown in FIG. 2, the exhale valve 2 is biased to its closed position, for example by a helical compression spring 14, so that the valve will only open to permit air to flow out of the facepiece when the air within the facepiece is at a preset pressure P above atmospheric pressure. The valve cracking pressure may for example be within the range 150 to 600 Pascals.

A one-way inlet valve 13 is mounted in the inlet 3 of the facepiece and permits air to flow from the pump to the facepiece. The valve 13 is arranged so that the valve will close as soon as the pressure downstream thereof within the facepiece exceeds that upstream thereof within the hose 4.

The operating parameters of the pump unit 5 are selected relative to the operating parameters of the exhale valve 2 so that the pump unit will cease or substantially cease operating effectively when the pressure at the outlet is of the order of but slightly less than the predetermined pressure P at which the exhale valve 2 opens. During inhalation the pump unit will operate normally and the inlet valve will be maintained open, the exhale valve being closed. During exhalation, the pressure within the facepiece will build up to a point at which it exceeds that in the hose 4. At this point, the valve 13 will close. The exhale valve will open shortly thereafter but meanwhile closure of valve 13 causes an increase in pressure within the hose to the point at which the pump unit will be placed in a condition in which it ceases or substantially ceases to operate effectively to draw air into the apparatus through the filters.

During normal operation of the pump unit 5, because of the resistance to flow presented by the or each filter canister 11, the pressure between the filter canister or canisters and the pump means is sub-atmospheric. When the pump means ceases or substantially ceases to operate effectively, the pressure between the pump means and the filter canisters increases from the sub-atmospheric pressure towards atmospheric pressure to equalise the pressure differential across the filter canisters. The pressure in the region between the fan inlet and the filter canisters is sensed by a pressure sensor 12, which as shown is mounted in this region, and which causes control means to be operated to disconnect the motor of the pump means from the battery when the pressure rises to a preset level, for example between about 100 and 140 Pascals below atmospheric pressure.

Towards the end of exhalation, the pressure within the facepiece will fall causing valve 2 to close and valve 13 to open. At the commencement of inhalation, there is a rapid and transient reduction of pressure in the facepiece which is communicated to the fan and to the fan inlet. The pressure sensor 12 is arranged to reverse the state of the control means on sensing this reduction of pressure to thus reenergise the motor. The pump unit will thus start operation again to supply the facepiece with the air required by the wearer for inhalation.

Thus by suitable selection of the operating parameters of the exhale valve and the pump unit, the energisation of the pump unit can be made to vary during the breathing cycle of the wearer, not only to reduce the amount of air which is drawn into the respirator through the filters and which is not then breathed, but also to reduce the power required from the battery and thus to extend the life of the battery.

The inertia of the pump unit 5 may be arranged so that the fan will continue to rotate after the motor has been de-energised to maintain the standing pressure in the hose 4, and so that the rotation will continue until the end of exhalation and the start of inhalation when the motor is re-energised. This additionally reduces the energy required each time the motor is re-energised to overcome the inertia of the pump unit.

Figure 4:
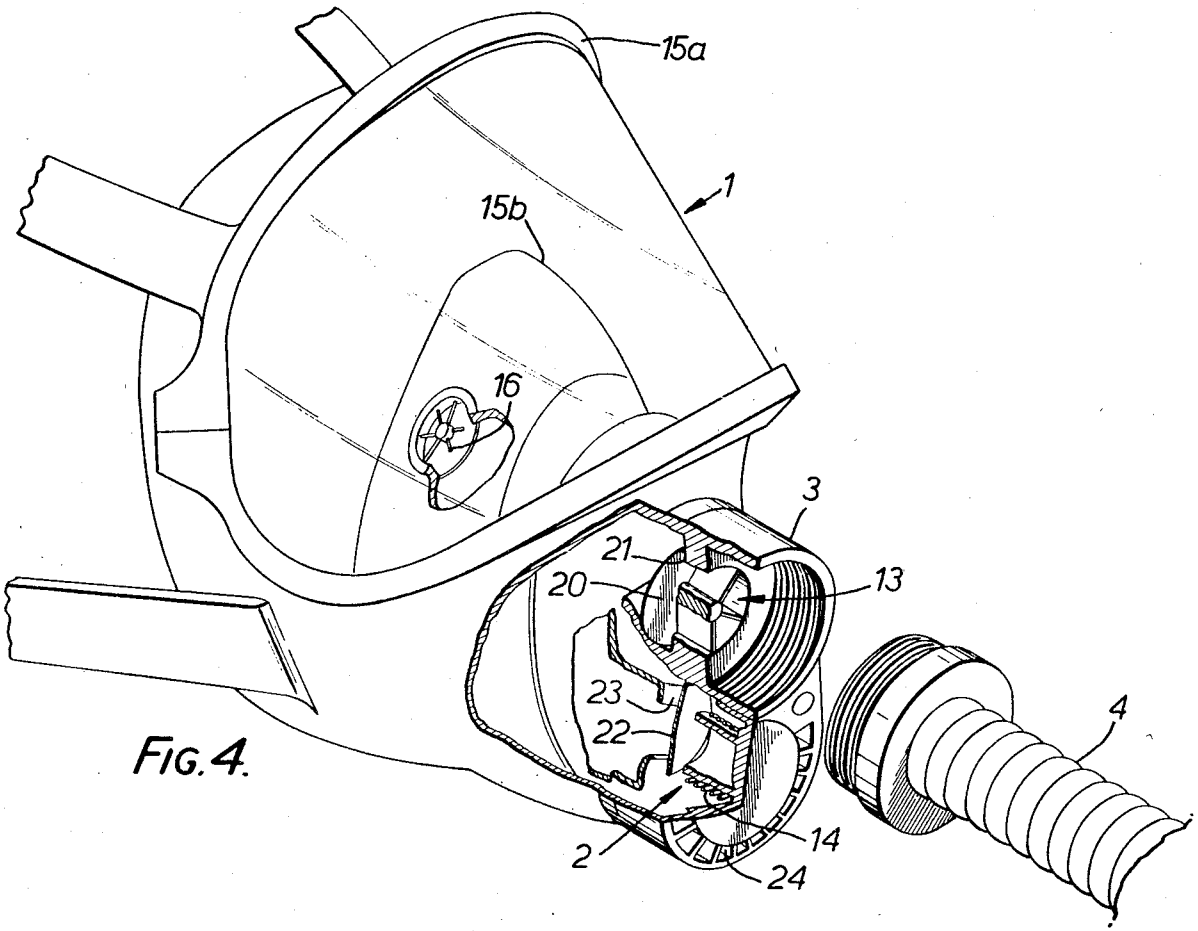
FIGS. 4 and 5 are perspective views with parts broken away of the respirator of FIG. 1 showing the inlet and outlet to the facepiece and the pump means respectively.

As shown in FIGS. 2 and 4, the facepiece 1 of this embodiment comprises an outer mask 15*a* which covers the face of the wearer and is peripherally sealed to the wearer's face, and an inner mask 15*b* which more closely surrounds the nose and mouth of the wearer. The outer mask is provided with the inlet 3 and the space within the inner mask communicates with the exhale valve 2 in the outlet, which conveniently penetrates both masks. Communication between the masks is provided by one or more apertures in the inner mask, the or each of which is provided with a one-way inlet valve 16. The valves 16 may for example be flap valves permitting flow of air from the outer mask to the inner mask but preventing flow of exhaled air into the total volume of the facepiece so as to limit the amount of exhaled air which may be re-breathed. If the inner mask is sufficiently well sealed to the wearer's face to prevent excessive leakage around the edges, the inlet valve 13 provided in inlet 3 may be omitted, the or each valve 16 performing its function.

Figure 5:
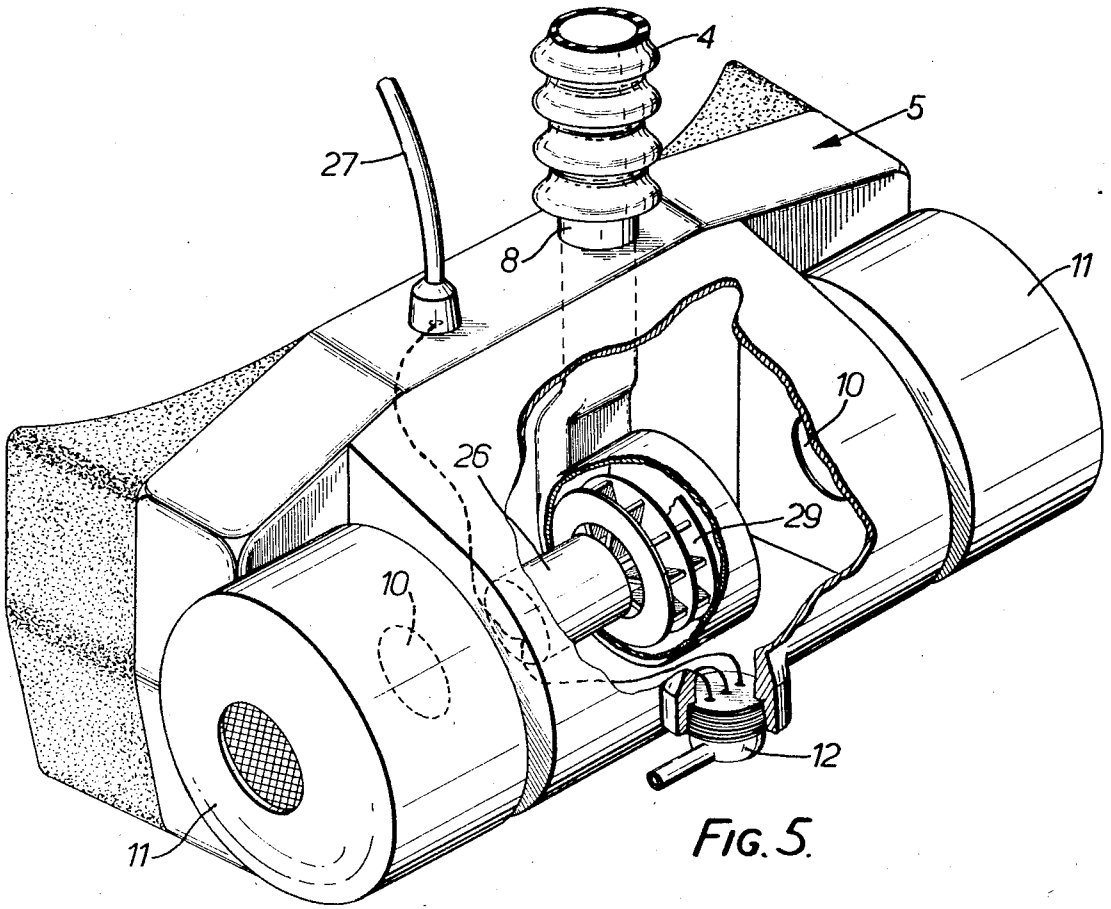

FIGS. 4 and 5 show preferred embodiments of the valves 2, 13 and the pump unit 5. As shown in FIG. 4, the valve 13 comprises a flap valve comprising a flexible disc 20 which is seated over a seat 21 surrounding an opening in the passage of inlet 3 to the facepiece. The disc 20 is normally in its closed position seated on seat 21 and lifts from seat 21 to allow air to flow into the facepiece when the pressure within the facepiece falls below that in the hose 4. The or each valve 16 may be similarly constructed.

The exhale valve 2 comprises a flap valve comprising a rigid disc 22 which seats against an outlet seat 23 surrounding the outlet opening and is biased to its closed position by a helical compression spring 14 which bears against the disc 22 and a part of the housing around the outlet. Air exits from the valve through openings 24 communicating with the opening in seat 23.

The pump unit 5 shown in FIG. 5 comprises a d.c. motor 26 connected by cable 27 to the battery and to the shaft 28 of a double centrifugal fan 29 whose outlet is connected to outlet 8 provided by the housing of the unit. The fan inlet is connected, as shown, to two housing inlets 10, each of which is threaded to receive a filter canister 11.

A preferred embodiment of the pressure sensor 12 is shown in FIG. 3 and comprises a housing 30 the interior of which is separated into two chambers by a diaphragm 31, each chamber having an inlet 32,33, one of which is placed in communication with atmospheric pressure and the other with the pressure to be sensed. The diaphragm 30 carries one contact of a switch 12*a*, the other switch contact being fixed. As shown, inlet 33 is in communication with the region between the fan and the filter cartridge and the switch 12*a* is normally open being closed so long as the pressure in the region of the fan inlet is maintained below the preset level. The switch 12*a* is connected in series with the battery 6, on/off switch 7 and the fan motor 26 in the energisation circuit of the motor. Alternatively, the sensor 12 may be arranged so that the switch 12*a* is open so long as the pressure in the region of the fan inlet is maintained below the preset level, and is closed when the pressure in the region of the fan inlet rises to the preset level to, for example, energise a relay which then causes disconnection of the motor from the battery. The energisation circuit may also include a by-pass circuit to by-pass the pressure sensor and the related control so that the respirator may be operated without the control provided by the sensor 12.

It will be appreciated that, while the invention has been described above in terms of a respirator comprising a facepiece in the form of inner and outer full face masks, it is equally applicable to single face masks which may be full face masks or partial face masks and to facepieces in the form of hoods or helmets which are adequately sealed to the head of the wearer. Additionally, while in the above described respirator, the inlet valve 13, where provided, is placed in the inlet to the facepiece, this valve may be provided at any convenient point intermediate the fan outlet and the facepiece.

Furthermore, while as described above the facepiece is connected to the pump unit and filter means by a flexible hose, the hose may be omitted, the pump unit and filter means being mounted on or in the facepiece, as will be described hereafter.

Figure 6:
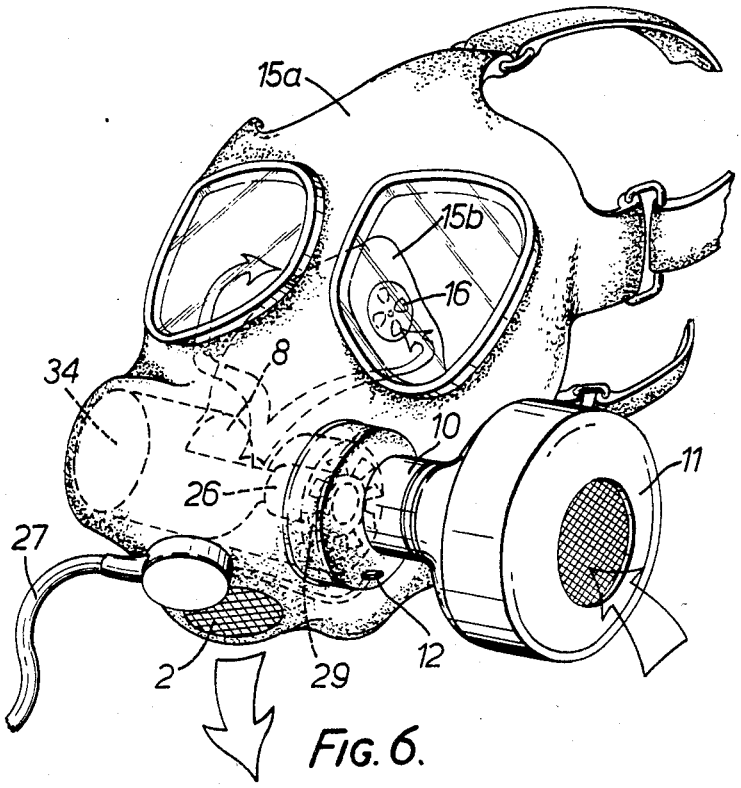
FIG. 6 is a perspective view of another embodiment of respirator according to the present invention.
Figure 7:
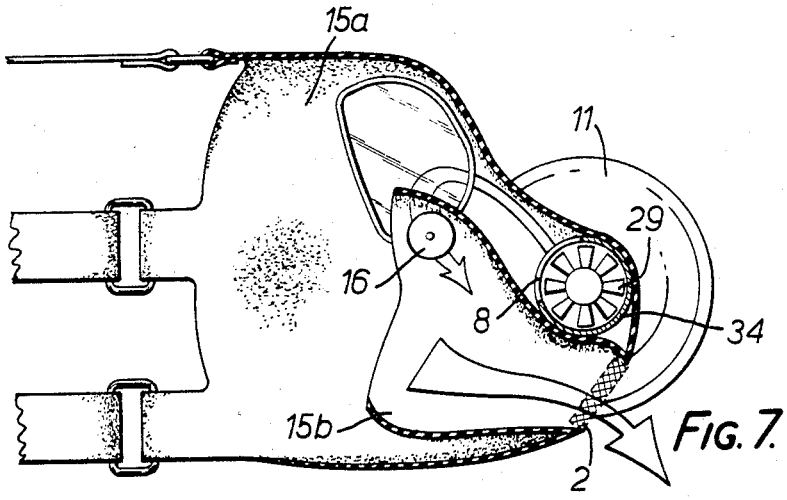
FIG. 7 is a section through the respirator of FIG. 6.

The respirator shown in FIGS. 6 and 7 comprises an outer mask 15*a* with an inner mask 15*b* similar to the masks of the facepiece shown in FIG. 2. As with the facepiece of FIG. 2, the outer mask 15*a* fits peripherally against the wearer's face so as to be sealed thereto and holds the inner mask, which covers the nose and mouth of the wearer, against the wearer's face so that it is also sealed thereto. The inner mask may for example be made of rubber or a synthetic plastics material.

The facepiece outlet and exhale valve 2 communicate with the inner mask and, for convenience, penetrate the outer mask, the two masks being sealed together at the periphery of the outlet. The inner mask is also provided with one or more, as shown two, apertures providing communication between the masks, the or each of which is provided with a one-way valve 16 permitting air to flow from the outer mask into the inner mask.

In this embodiment, the pump unit 5 is mounted within the outer mask 15*a*. The pump unit may take a variety of different forms. As shown, the housing of the pump unit has the form of a cross-tube 34 extending within the outer mask above the exhale valve laterally across the front of the outer mask. The tube 34 has an inlet 10 at one end, as shown the left hand end, which is also the facepiece inlet (3), opening laterally of the facepiece. The cross-tube 34 has an outlet opening intermediate its end which provides the pump unit outlet 8 and which communicates with the space within the outer mask. An axial fan 29 is mounted within the tube 34 adjacent that end provided with the inlet 10 to draw air into the tube 34 through inlet 10 and expel it through outlet 8. The fan 29 is driven by a d.c. motor 26 which is, as in the above described embodiment, battery operated and is connected by cable 27 to a separate unit housing the battery or batteries and optionally an on/off switch controlling power supplied to the motor.

The inlet 10 of the facepiece and pump unit is threaded and receives a filter canister 11.

As in the above described embodiment, a pressure sensor 12 is arranged in the region of the inlet of the fan to sense the pressure between the fan and the filter canister. The sensor 12 is conveniently mounted within the casing 34 adjacent the fan inlet and is associated with a switch 12*a* connected in the energisation circuit of the motor 26 as described in the preceding embodiment.

The valves 2 and 16 and the sensor 12 are preferably constructed as in the preceding embodiment and the operating parameters of the exhale valve in relation to those of the fan 29 are selected so that the respirator operates as described in relation to the embodiment of FIGS. 1 to 5. It will however be appreciated that, in this embodiment, control of the pump unit is more responsive to the breathing cycle of the wearer because of the omission of the volume of the flexible hose 4 between the facepiece and the pump unit.

In a modification of the above described embodiment, the inner mask 15*b* may be omitted or the valves 16 may be omitted. A one-way valve, replacing valve(s) 16 is then arranged in the path of air from the pump unit, e.g. in the region of outlet 8.

Figure 8:
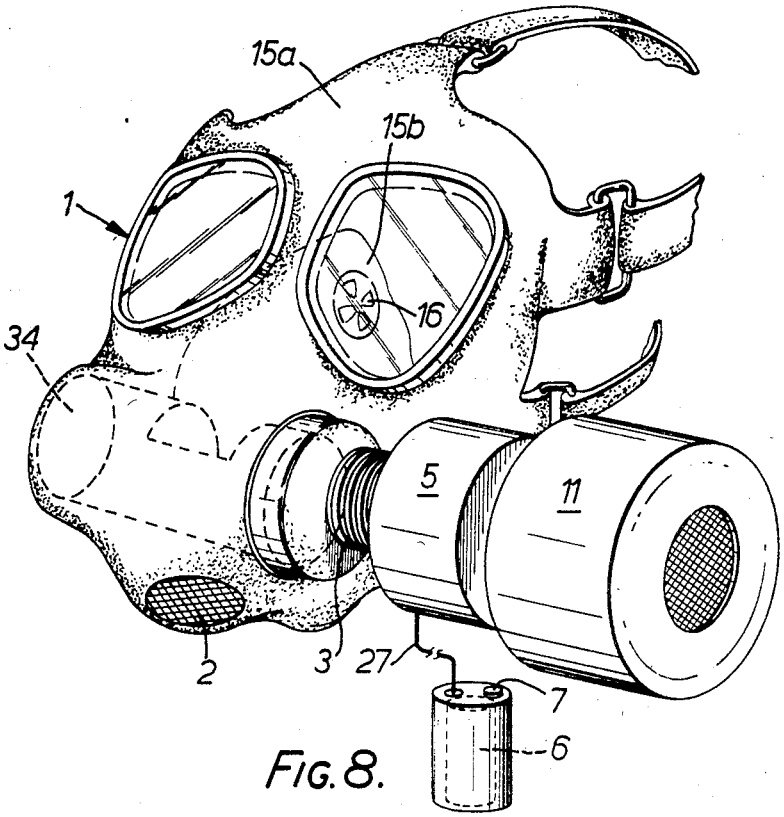
FIG. 8 is a perspective view of yet another embodiment of respirator according to the present invention.
Figure 9:
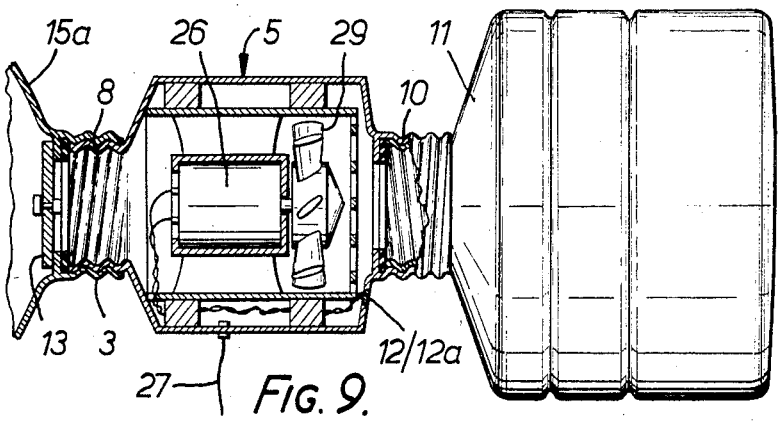
FIG. 9 is a part sectional view showing the pump means of the respirator of FIG. 8.
Figure 10:
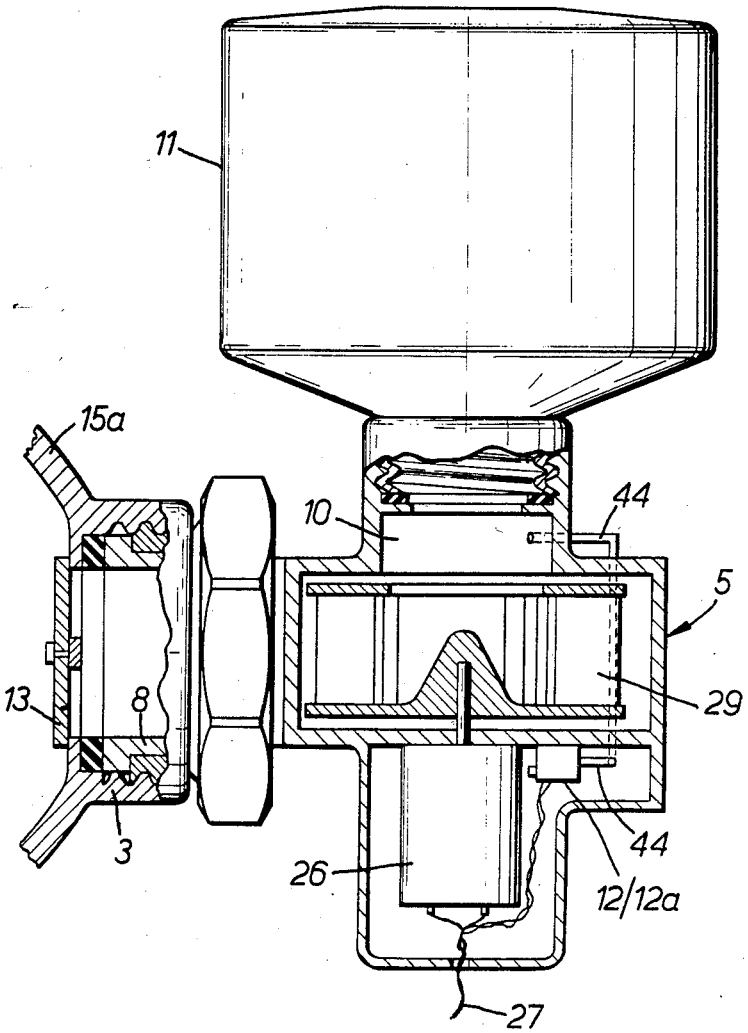
FIG. 10 is a part sectional view showing a modification of the pump means of FIG. 9.

In the embodiments of FIGS. 8 to 10 the pump unit 5 is in the form of a module for connection to the inlet of the facepiece. As shown the facepiece 1 has a construction similar to the facepiece of the embodiment of FIGS. 6 and 7 with an outer mask 15*a* and an inner mask 15*b* and the cross-tube 34 provided within the outer mask. As with the facepiece of FIGS. 6 and 7, the inner mask 15*b* communicates with the exhale valve 2 and with the outer mask through apertures provided with one-way valves 16. A one-way valve 13 may also be provided in the inlet 3 of the face mask (corresponding to inlet 10 in the embodiment of FIGS. 6 and 7). In the embodiment of FIGS. 8 and 9, the pump unit 5 comprises an axial fan 29 drive by a d.c. motor 26 and the unit housing has a threaded inlet 10 for receiving the outlet of a filter canister 11. The energisation circuit of the motor 26 is as described in relation to the embodiment of FIGS. 1 to 5 and includes the switch 12*a* associated with pressure sensor 12 which is mounted within the pump unit casing in the region of the fan inlet. The operation and operating parameters of this embodiment of respirator are exactly the same as those of the preceding embodiments and it has the additional advantage of the embodiment of FIGS. 6 and 7.

FIG. 10 shows an alternative form of pump unit 5 for connection to the facepiece of FIG. 8 in place of the pump unit shown in FIGS. 8 and 9. In this embodiment, the fan 29 is a centrifugal fan which is, as in the preceding embodiments, driven directly by a d.c. motor whose energisation circuit is exactly the same as that of the embodiment of FIGS. 1 to 5. However, in this embodiment the pressure sensor 12 is, for convenience, mounted within a part of the housing of the pump unit 5 in which the motor 26 is located and which is separate from that in which the fan 29 is located. This part of the housing is vented to the atmosphere to provide atmospheric pressure in the appropriate one of the chambers of the pressure sensor 12. The other chamber is connected by a duct 44 to the region of the inlet of the fan 29 so that this other chamber of the pressure sensor is at the pressure prevailing in the region of the fan inlet. The inlet 10 of the pump unit is, as in the embodiment of FIGS. 8 and 9, threaded to receive a filter canister 11. The operation and operating parameters of this embodiment of respirator are exactly the same as described in relation to the embodiment of FIGS. 1 to 5.

It will be appreciated that the embodiments of FIGS. 8 to 10 are equally applicable to other forms of facepieces as referred to above which are capable of supporting the pump unit and filter canister.

What I claim is:

1. A power assisted respirator comprising a facepiece defining a space for covering the mouth and nose of the wearer and having an inlet and an outlet for air, one-way exhale valve means in said outlet which is operable to permit air to flow out of said space within said facepiece when a predetermined differential pressure is established thereacross, non-positive displacement pump means having inlet means for air and an outlet, said pump means permitting, in its inoperative state, flow of gas between said inlet means and said outlet, battery means connected to said pump means for energizing said pump means, said outlet being connected to the inlet of said facepiece for supplying air thereto, one-way inlet valve means between said pump outlet and said space, said one-way inlet valve means permitting air to flow from said pump outlet to said space through said inlet of said facepiece but not in the reverse direction when the pressue in said space exceeds the pressure at the outlet of said pump means, the operating parameters of said pump means and said exhale valve means being selected so that, during exhalation by the wearer, the inlet valve means will close and the pump means will be placed in a condition in which it will substantially cease to operate effectively, filter means connected to said inlet means of said pump means for filtering air supplied thereto, pressure sensor means connected between said pump means and said filter means for sensing the pressure of air passing between said pump means and said filter means, and control means responsive to said pressure sensor means for causing disconnection of said pump means from said battery means when the pressure sensed by said pressure sensor means rises above a preset level.

2. A respirator as claimed in claim 1, wherein said inlet valve means comprises at least one valve arranged such that it will close as soon as the pressure downstream thereof exceeds the pressure upstream thereof.

3. A respirator as claimed in claim 1, wherein said operating parameters of said pump means and said exhale valve means are such that the pressure in said space within said facepiece at which said exhale valve means will open is slightly greater than the pressure at the outlet of said pump means at which said pump means will cease or substantially cease to operate effectively.

4. A respirator as claimed in claim 1, including a flexible hose connecting said pump means to said inlet of said facepiece, said pump means comprising a housing for mounting on the body of the wearer.

5. A respirator as claimed in claim 4, wherein said filter means is mounted on said inlet means of said pump means.

6. A respirator as claimed in claim 1, wherein said outlet of said pump means is connected directly to said inlet means of said facepiece, said pump means being mounted on said facepiece.

7. A respirator as claimed in claim 1, wherein said facepiece comprises an outer mask provided with said facepiece inlet and an inner mask provided with said facepiece outlet, said inner mask being provided with at least one aperture which is provided with a one-way valve permitting air to flow into the space within said inner mask.

8. A respirator as claimed in claim 7 wherein said inlet valve means comprises a one-way valve mounted in said facepiece inlet.

9. A respirator as claimed in claim 7, wherein said inlet valve means comprises said one-way valve associated with said aperture in said inner mask.

10. A respirator as claimed in claim 1, wherein said pump means is housed within said facepiece, said inlet means of said facepiece providing said inlet means of said pump means.

11. A respirator as claimed in claim 10, wherein said filter means is mounted on said inlet means of said facepiece.

12. A respirator as claimed in claim 10, wherein said facepiece comprises an outer mask and an inner mask covering the nose and mouth of the wearer, said pump means being housed between said inner and outer masks, said outer mask being provided with said facepiece inlet and said inner mask being provided with said facepiece outlet, said inner mask being provided with at least one aperture which is provided with a one-way valve permitting air to flow from the space within said outer mask into the space within said inner mask.

13. A respirator as claimed in claim 12, wherein said inlet valve means is provided by said one-way inlet valve associated with said aperture in said inner mask.

14. A power assisted respirator comprising a facepiece defining a space for covering the mouth and nose of the wearer and having an inlet and an outlet for air, one-way exhale valve means in said outlet which is operable to permit air to flow out of said space within said facepiece when a predetermined differential pressure is established thereacross, non-positive displacement pump means for supplying air to said space within said facepiece and comprising a body having inlet means for air and an outlet connected to the inlet of said facepiece, a fan in said body for moving air from said inlet means to said outlet and a d.c. motor for driving said fan, said pump means permitting, in its inoperative state, flow of gas between said inlet means and said outlet, power means comprising an energisation circuit including battery means connected to said motor for energising said motor, one-way inlet valve means between said pump outlet and said facepiece the space within said facepiece permitting air to flow from said pump outlet to said space through said inlet of said facepiece but not in the reverse direction when the pressure in said space exceeds the pressure at the outlet of said pump means, the operating parameters of said pump means and said exhale means being selected so that, during exhalation by the wearer, said inlet valve means will close and said fan will be placed in a condition in which it will cease or substantially cease to operate effectively, filter means connected to said inlet means of said pump means for filtering air supplied thereto, pressure sensor means connected between said pump means and said filter means for sensing the pressure of air passing between the inlet means of said pump means and said filter means, and control means responsive to said pressure sensor means including a switch operable by said pressure sensor means and connected in said energisation circuit of said motor for causing disconnection of said motor from said battery means when the pressure sensed by said pressure sensor means rises above a preset level.

15. A respirator as claimed in claim 14, wherein said operating parameters of said pump means and said exhale valve means are such that the pressure in said space within said facepiece at which said exhale valve means will open is slightly greater than the pressure at the outlet of said pump means at which said fan will cease or substantially cease to operate effectively.

* * * * *